United States Patent [19]

Kurosawa et al.

[11] Patent Number: 4,484,858

[45] Date of Patent: Nov. 27, 1984

[54] TURBINE ROTOR WITH MEANS FOR PREVENTING AIR LEAKS THROUGH OUTWARD END OF SPACER

[75] Inventors: Soichi Kurosawa; Katsuo Wada; Mitsuo Teranishi, all of Hitachi, Japan

[73] Assignee: Hitachi, Ltd., Tokyo, Japan

[21] Appl. No.: 445,979

[22] Filed: Dec. 1, 1982

[30] Foreign Application Priority Data

Dec. 3, 1981 [JP] Japan ..... 56-193696

[51] Int. Cl.[3] ..... F01D 5/06

[52] U.S. Cl. ..... 416/95; 416/193 A; 416/198 A; 416/201 R

[58] Field of Search ..... 416/95, 193 A, 198 A, 416/200 R, 200 A, 201 R, 201 A

[56] References Cited

U.S. PATENT DOCUMENTS

| | | | |
|---|---|---|---|
| 2,356,605 | 8/1944 | Meininghaus | 416/193 A X |
| 2,656,147 | 10/1953 | Brownhill et al. | 416/97 R |
| 3,801,220 | 4/1974 | Beckershoff | 416/95 X |
| 4,021,138 | 5/1977 | Scalzo et al. | 416/95 |
| 4,035,102 | 7/1977 | Maghon | 416/95 |
| 4,088,422 | 5/1978 | Martin | 416/198 A |
| 4,265,594 | 5/1981 | Eggmann | 416/95 X |

FOREIGN PATENT DOCUMENTS

| | | | |
|---|---|---|---|
| 1182474 | 11/1964 | Fed. Rep. of Germany | 416/95 |
| 1185415 | 1/1965 | Fed. Rep. of Germany | 416/95 |
| 851306 | 10/1960 | United Kingdom | 416/95 |

*Primary Examiner*—Everette A. Powell, Jr.
*Attorney, Agent, or Firm*—Antonelli, Terry & Wands

[57] ABSTRACT

A turbine rotor provided with a sealing member for preventing air leaks through a gap between the under side surface of a projection extending from one of discs of the rotor and the upper side surface of a outward end portion of the spacer interposed between the discs. The spacer is formed with an annular groove on the upper side surface of the outward end portion for receiving a sealing wire in its entirety. The sealing wire has its outer portion forced against the underside surface of the projection by centrifugal forces while its inner portion remains inside the groove during turbine operation, to thereby seal the gap to prevent leaks of air therethrough.

3 Claims, 9 Drawing Figures

TURBINE ROTOR WITH MEANS FOR PREVENTING AIR LEAKS THROUGH OUTWARD END OF SPACER

BACKGROUND OF THE INVENTION

This invention relates to turbine rotors of gas turbines, steam turbines, etc., and, more particularly, to a turbine rotor comprising a plurality of shafts and turbine discs each with including a blade secured to an outer periphery of a turbine wheel, a spacer mounted between the two adjacent discs, and with the rotor being provided with means for preventing a leakage of air flowing through the interior of the rotor for cooling the through an outer end of the spacer.

Generally, a rotor formed by combining a plurality of discs and shafts is constructed such that discs and shafts are stacked in a superposed relation and secured to one another by bolts so as to form the rotor.

However, a rotor of the aforementioned type suffers the disadvantage that air leaks through the outer end of the spacer in large amount as will be more fully understood from the following description of a cooling air system of a prior art rotor shown in FIG. 1.

More particularly, as shown in FIG. 1, a rotor includes at least first and second stage a wheels 1 and 3, a plurality of blades 4 and 5 respectively secured to outer peripheries of the wheels 1, 3 to form discs generally designated by the reference numerals 1*a* and 3*a*, a spacer 2 being interposed between the two discs 1*a*, 3*a* and shafts S1 and S2, stacked in superposed relation, secured to the discs 1*a*, 3*a*. A combustion gas flowing in a direction incidated by an arrow A impinges on the blades 4 and 5 to rotate the rotor. The wheels 1, 3, in the form of discs coaxial with the shafts S1, S2, are respectively formed with air passages 1*b* and 3*b* in central portions thereof. In this case, air 9 for cooling the blades 4 and 5 is led to the interior of the rotor through inlet ports 10 and flows through the air passages 3*b* in the central portion of the rotor before reaching an inner space 21 of the spacer 2 between the first stage wheel 1 and the second stage wheel 3. The spacer 2 is formed with a plurality of slits 8 at a surface thereof contacting the first stage wheel 1 for maintaining communication between the inner space 21 and an air sump 6 adjacent the outer periphery of the rotor. Thus, the air 9 for cooling the blades 4 and 5 flows through a channel constitutetd by the inlet ports 10, the central portion of the rotor, i.e. air passages 1*b* and 3*b*, inner space 21 of the spacer 2, slits 8 and cooling air sump 6.

As shown in FIG. 2, the cooling air 9 entering the cooling air sump 6, after flowing through the slits 8, is introduced into a bottom groove 7 between the first stage wheel 1 and the first stage blade 4 and then flows into radially extending blade cooling ducts 12 in the first stage blade 4 to cool same, before being vented through a top portion 41 of the blade 4.

To enable the cooling air 9 to attain the end of effectively cooling the first stage blade 4, the cooling air 9 only has to be led from the cooling air sump 6 to the bottom groove 7 without any air leaks. To this end, attempts have been made to provide the blade 4 with a projection 42 which is located at a lower portion of the blade 4 and extends toward the center of the rotor in such a manner that it overlaps the outer periphery of the spacer 2 to prevent air leaks through the outward end portion of the spacer 2, as viewed in a peripheral direction of the spacer 2. However it is impossible to bring the first stage blade 4 into intimate contact with the spacer 2 during operation to eliminate a gap 11 between the blade 4 and spacer 2 since it is necessary to provide a clearance between the projection 42 of the first stage blade 4 and the spacer 2 to avoid impinging of the projection 42 against the outer peripher of the spacer 2 which might otherwise occur due to an accumulation of allowed tolerances of these parts when they are separately fabricated. The provision of the clearance is also necessary in view of deformation of the first stage wheel 1 and the spacer 2 which would occur during operation due to centrifugal forces and thermal stresses.

As shown in FIG. 3, length 11′ of the gap 11, initially 0.24, becomes longer by 0.05 mm during operation because the first stage wheel 1 undergoes deformation in larger amount than the spacer 2 due to the centrifugal forces of the first stage blade 4. Thus, the gap 11 has a length of 0.29 during operation. In FIG. 3, the line 13 depicts a rise in rpm and a line 14 depicts a rise in a load. As apparent from FIG. 3, the length 11′ of the gap 11 increases as the rpm rises and continues to increase even after the rpm has become constant, until the load becomes substantially constant, and thereafer the length 11′ becomes flat.

As shown most clearly in FIG. 4, leaks 17, in kilograms per second, are substantially proportional to the length 11′, and the leaks are large even if the gap 11 is small since the spacer 2 has a large diameter at its outer periphery and the cooling air 9 in the cooling air sump 6 is a high pressure. The leaks 17 represent about 40% of the air cooling the first stage blade 4 and about 0.5% of the main gas flowing in stream.

In FIG. 5, the ordinate represents a percentage reduction in thermal efficiency and as can be seen from FIG. 5, the thermal efficiency shows a reduction of 0.25% which represents a great loss.

Thus, the prior art suffers the disadvantage that the leaks through the gap between the projection 42 of the first stage blade 4 and the spacer 2 cause a reduction in thermal efficiency. This also gives rise to the problem that the gap 11 shows a change in size due to deformation of the wheel 1, 3 and spacer 2 during rotor operation and the cooling air has nonstatic stability.

SUMMARY OF THE INVENTION

This invention has been developed for the purpose of obviating the aforesaid problems of the prior art with regard to the gap between the blade and the spacer. Accordingly the invention has as its object the provision of a turbine rotor with means for preventing air leaks through a outward end of the spacer capable of avoiding the cooling air becoming nonstatic due to a change in the gap size by reducing leaks of the cooling air through the outward end of the spacer, to thereby increase the efficiency with which the blades are cooled and improve the thermal efficiency of the rotor.

To accomplish the aforesaid object, the invention provides means for sealing the gap between the discs constituted by wheels having blades secured thereto and the spacer interposed between the discs by centreifugal forces during rotor operation.

The invention can achieve the effect of preventing leaks of the cooling air through the forward end of the spacer by virtue of the sealing means during rotor operation, thereby improving the thermal efficiency of the rotor.

DETAILED DESCRIPTION

Figure 1:
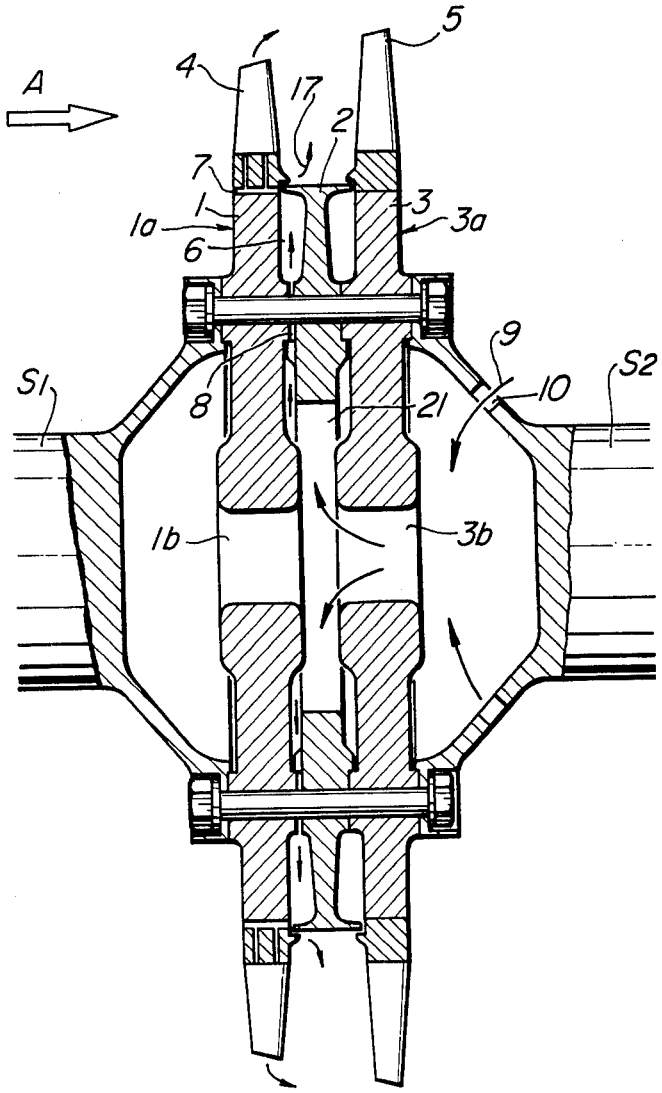
FIG. 1 PRIOR ART
FIG. 1 is a cross-sectional view of the construction of a rotor of the prior art.
Figure 2:
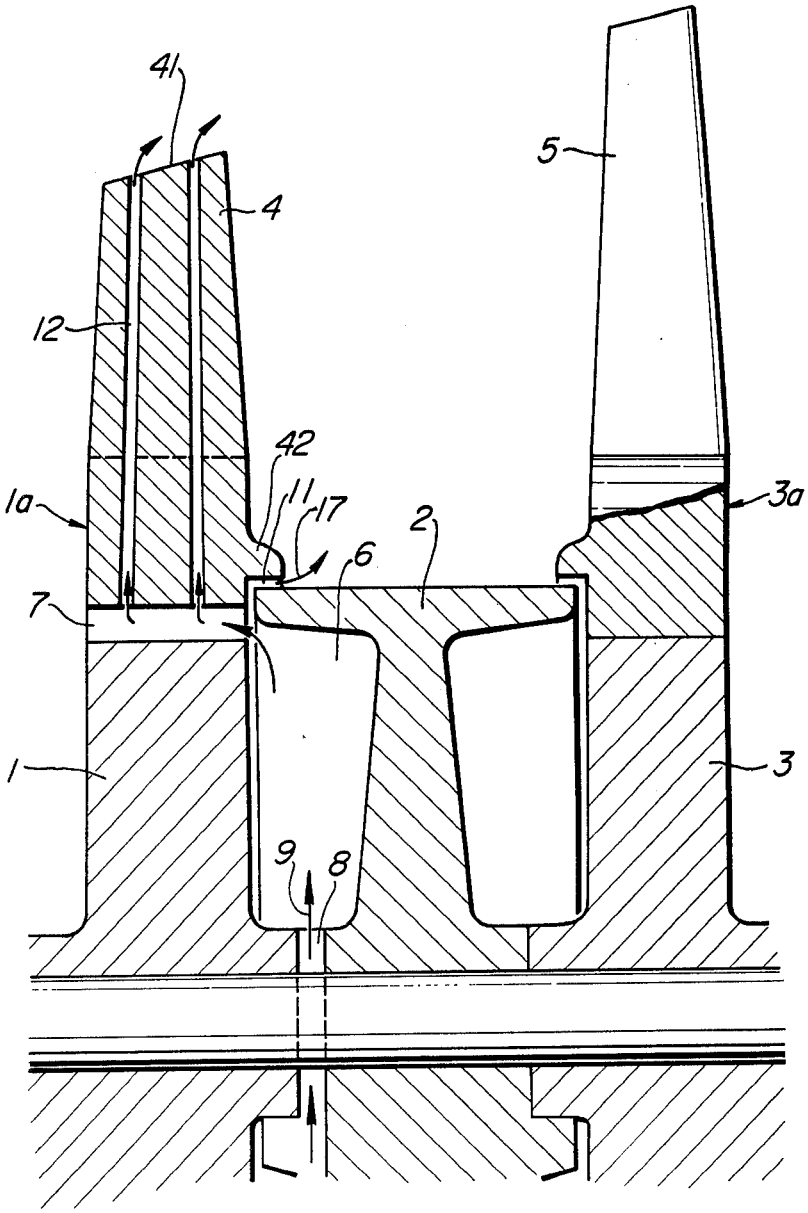
FIG. 2 PRIOR ART
FIG. 2 is a fragmentary cross-sectional detail view of, on an enlarged scale, the rotor shown in FIG. 1.
Figure 6:
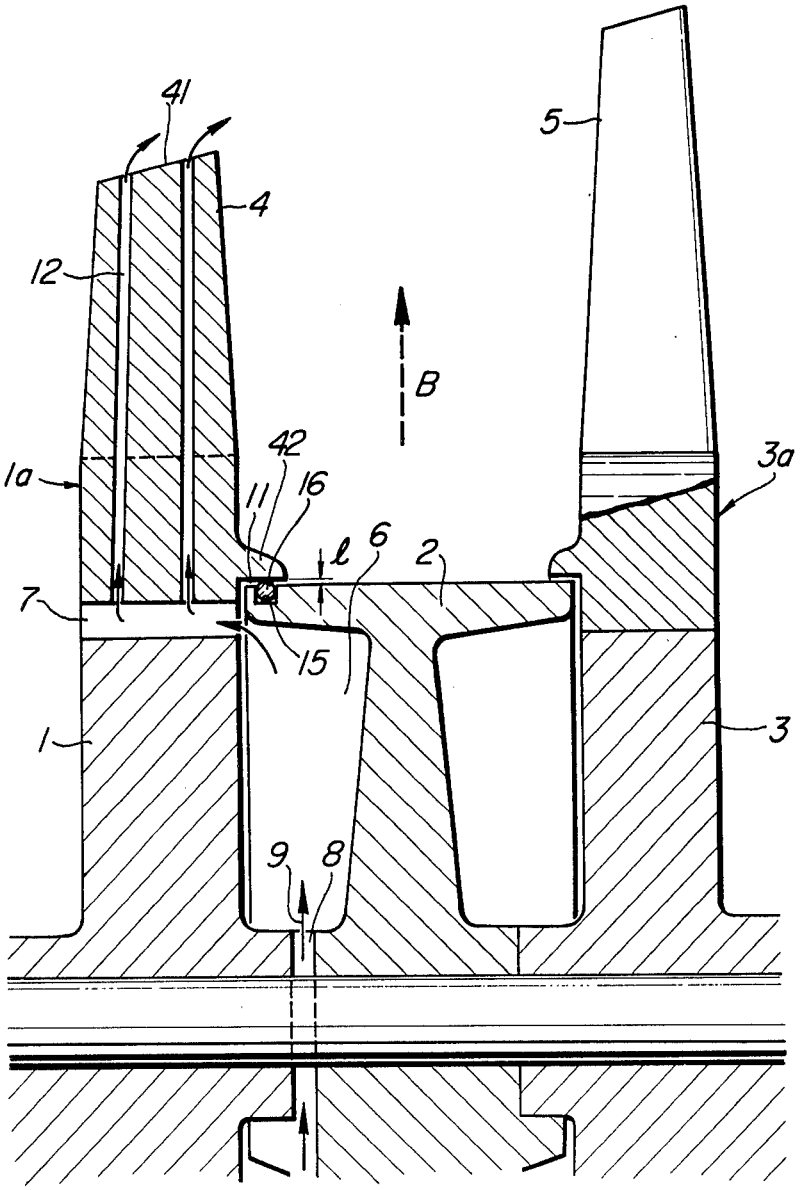
FIG. 6 is a cross-sectional view of portions of a rotor comprising one embodiment of the present invention.

Referring now to the drawings wherein like reference numerals are used throughout the various views to designate like parts and, more particularly, to FIG. 6, according to this figure, a rotor comprises a first stage wheel 1 and a second stage wheel 3, and a first stage blade 4 and a second stage 5 respectively placed on outer peripheral portion of the wheels 1, 3 to form discs 1*a*, 3*a*. A spacer 2 is mounted between the discs 1*a*, 3*a*, so that the discs 1*a*, 3*a* and the spacer 2 are combined with shafts S1, S2 (FIG. 1) to form the rotor. The rotor is constructed such that a current of air is passed through its interior thereof to cool the blades 4, 5. A seal 16 is mounted between the disc 1*a* and the spacer 2 to prevent leakage of air through the outward or outer peripheral end of the spacer 2.

Figure 3:
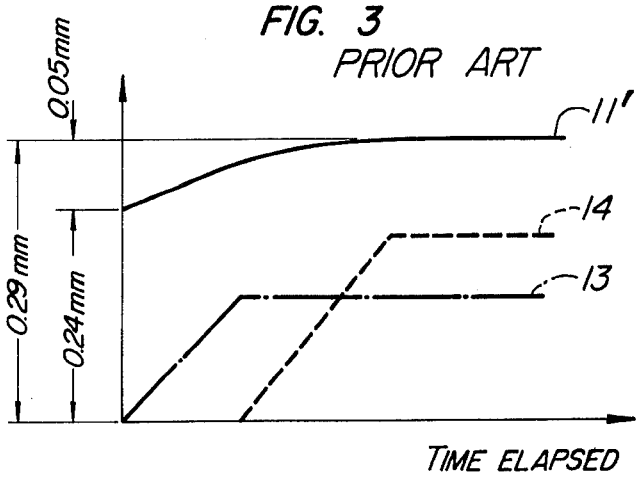
FIG. 3 PRIOR ART
FIG. 3 is a graphical illustration of a relationship of a gap length with respect to elapsed time following a start-up of a turbine employing the rotor of FIG. 1.
Figure 4:
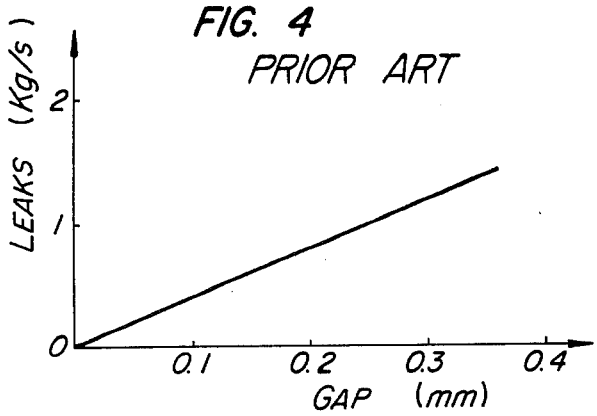
FIG. 4 PRIOR ART
FIG. 4 is a graphical illustration of a relationship of gap length to air leakage.
Figure 5:
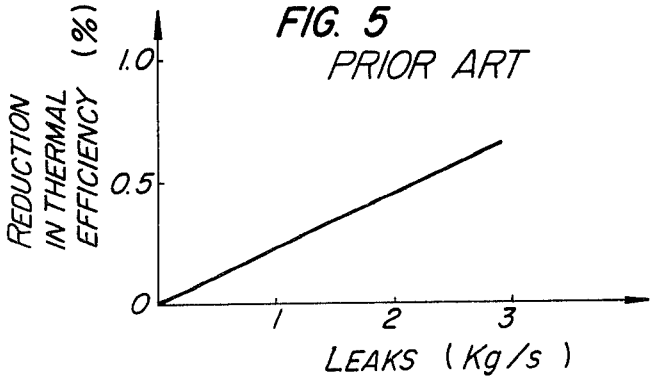
FIG. 5 PRIOR ART
FIG. 5 is a graphical illustration of thermal efficiency caused by air leakage.

The first stage blade 4 is formed with a projection 42 extending toward the spacer 2 in such a manner that an inner side surface thereof is located in a superposed relationship with respect to the outer side surface of the spacer 2. The spacer 2 is formed, in a portion thereof, located below the projection 42, with a sealing groove 15 which extends about the entire periphery of the spacer 2. The groove 15 is located immediately below or directly inwardly of the projection 42 of the blade 4 and has a width which is smaller than the length of the projection 42. The groove 15 has a depth which is equal to the width thereof and should be over ten times a gap l between the blade 4 and the spacer 2. The gap l may become wider when the rotor operates as described above in connection with FIG. 3, so that if the groove 15 is too shallow or narrow, a wire 16, which serves as a sealing member might be dislodged therefrom or caught between the spacer 2 and projection 42 and cause trouble. Thus, the groove 15 preferably has a substantial depth, and it is considered likely that if the depth of the groove 15 is over ten times as great as the gap l there is almost no risk of developing trouble.

The sealing wire 16, of the same diameter as the width of the groove 15, is placed in the groove 15 as a sealing member to be snugly fitted therein. In actual practice, the sealing wire 16 may have a width which is slightly smaller than the width of the groove 15 so as to enable the wire 16 to be shifted by centrifugal forces outwardly or upwardly in FIG. 6 in the groove 15 when the rotor rotates thereby intentionally bringing the wire 16 into pressing engagement with the inner side surface or lower side surface of the projection 42 of the blade 4.

Figure 7:
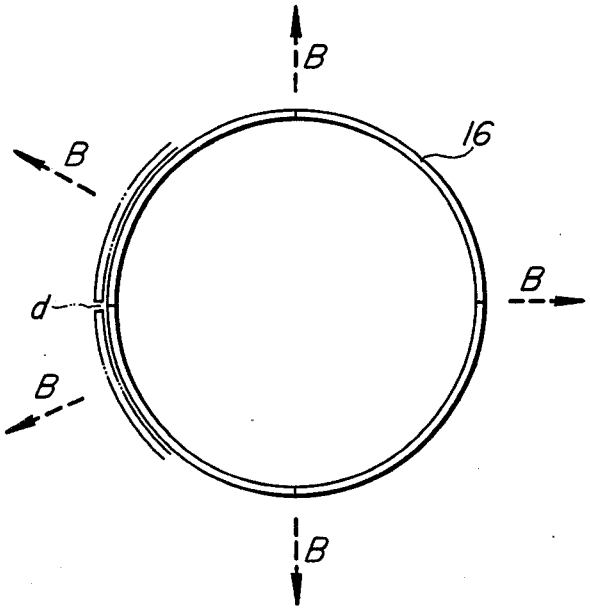
FIG. 7 is a schematic plan view of a sealing wire of rotor in FIG. 6.

The sealing wire 16 extends about the entire outer circumference of the rotor along the outer side surface of the spacer 2. As shown in FIG. 7 the sealing wire 16 is split into, for example, for segments. If the sealing wire 16 were in one piece, it would be difficult for the wire 16 to be shifted outwardly from the groove 15 when the spacer 2 is forced to move outwardly by centrifugal forces. However, by splitting the wire 16 into a plurality of segments, it is possible for the wire 16 to be readily deformed radially outwardly as indicated by an arrow B so that the wire segment would be deformed as shown dash-and-dot lines.

The sealing wire 16 may be embedded in the groove 15 of the spacer 2 when the parts are stacked to form the rotor, and the spacer 2 may be stacked on the first stage wheel 1 in a superposed relation.

Figure 8A:
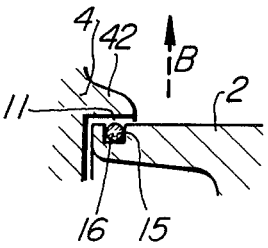
FIGS. 8*a* and 8*b* are cross-sectional views of a modification of the sealing wire shown of FIG. 7.
Figure 8B:
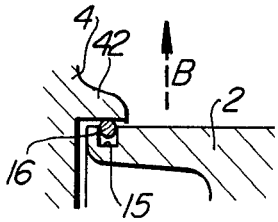

As shown in FIG. 8*a*, when the parts of the rotor are assembled, the outer side surface of the spacer 2 and the outermost peripheral surface of the sealing wire 16 in the groove 15 are flush with each other. As the rotor rotates, the sealing wire 16 is urged to move outwardly of the groove 15 by centrifugal forces or by a force acting thereon in the direction of the arrow B in FIGS. 6–8 thereby resulting in the sealing wire 16 being shifted in the direction of the arrow B into abutting engagement with the projection 42 of the spacer 2. An increase in the number of revolutions of the rotor causes the centrifugal forces of the sealing wire 16 to overcome the resilience thereof, with a result being that the sealing wire 16 undergoes deformation and the diameter thereof, as measured at its outermost periphery, becomes equal to the inner diameter, that is, the diameter of the peripheral surface constituted by the inner side surface of the projection 42 of the blade 4. Thus, the sealing wire 16 is brought into intimate contact with the blade 4 as shown in FIG. 8*b* on the outer peripheral surface of the wire 16 thereby enabling the clearance 11 to be perfectly closed by the sealing wire 16 and eliminating leaks of the cooling air 9 through the gap 11. Even if the gap 11 changes its size as a result of deformation of the wheel 1 or spacer 2 due to rotor operation, the sealing wire 16 is capable of performing the sealing function and no leaks of the cooling air 9 occur.

The sealing wire 16 is split into a plurality of segments along its extension, so that the wire 16 can be readily deformed by the centrifugal forces and pressed against the projection 42 of the spacer 2 to be brought into intimate contact therewith, to positively perform a sealing function. If the wire 16 were split into segments, a gap d (see FIG. 7) may be formed between the adjacent wire segments; however, the gap d is very small and air leakage therethrough is insignificant so as not to cause any problem in actual practice.

While no gaps are formed in a one piece sealing wire 16, a one piece sealing wire 16 would require centrifugal forces of high intensity to overcome the resilience thereof.

Any material may be used for forming the sealing wire 16 so long as it enables the wire to perform a sealing fuction. For example, a piano wire or a wire of stainless steel may be used; however, different materials may be used for forming the sealing wire 16 depending on the temperature at which the wire is used; namely, or the conditions under which it is used intensity of centrifugal forces, leaks without means for prevention, one piece or segmental form of sealing wire, etc. It is not so much the material of the sealing wire 16 as the thickness or diameter thereof that is important in defining the ability of the sealing wire 16 to perform the sealing function.

The sealing member in not limited to a wire, and it is sufficient for any known material to be used so long as the sealing member satisfactorily perform the intended sealing function.

From the foregoing description, it will be appreciated that the rotor according to the invention is provided with means for preventing leaks of cooling air through a forward end of the spacer or through a gap between the disk formed by fixing the blade to the wheel and the spacer with such leak preventing means comprising a sealing member capable of providing a seal to the gap by centreifugal forces when the rotor rotates. Thus, leaks of air through the gap can be positively prevented and all the cooling air in the interior of the rotor can be effectively used for cooling the blades with high efficiency. The sealing member has enough elasticity to cope with any change in the size of the gap which might be caused by deformation of the wheel and the spacer during rotor operation, to say nothing of being able to positively close the gap as it originally existed. This eliminates the occurrence of nonstatic stability of the cooling air which might otherwise be caused by a change in the gap, thereby enabling cooling effects to be positively achieved and allowing prevention of leaks of the cooling air to be effected, and is conducive to an improvement in thermal efficiency and in rotor efficiency.

What is claimed is:

1. A rotor comprising:

a plurality of turbine discs each having a blade secured to an outer periphery of a turbine wheel;

a spacer means mounted between two adjacent discs, said turbine discs, said spacer means and turbine shafts being assembled to form a turbine rotor; and means for preventing a leakage of air through an outer end of said spacer means of air flowing through an interior of said rotor to cool said blades, said means for preventing includes an annular projection formed on an axial end surface of each of said discs, said annular projecting extending axially toward said spacer means in such a manner that an inner annular surface of said annular projection is located in a superposed relationship to an outer cylindrical surface of said spacer means adjacent thereto, a circumferential groove formed in said outer cylindrical surface of said spacer means facing said inner annular surface of said annular projection, and a sealing means mounted in said circumferential groove for sealing a gap between said outer cylindrical surface of said spacer means and said inner annular surface of said annular projection under an action of centrifugal forces during an operation of said rotor.

2. A rotor as claimed in claim 1, wherein said sealing means includes a wire.

3. A rotor as claimed in one of claims 1 or 2, wherein said sealing means is divided into a plurality of sections and arranged about an outer periphery of said spacer means.

* * * * *